United States Patent [19]

Hyland et al.

[11] 4,126,225

[45] Nov. 21, 1978

[54] POULTRY CONTAINER

[75] Inventors: William C. Hyland, Monterey; Elmer G. Swanson, Salinas, both of Calif.

[73] Assignee: Champion International Corporaton, Stamford, Conn.

[21] Appl. No.: 810,041

[22] Filed: Jun. 27, 1977

[51] Int. Cl.[2] ..... B65D 5/54

[52] U.S. Cl. ..... 206/607; 206/626; 229/46; 229/6 A

[58] Field of Search ..... 206/620, 621, 626, 607, 206/630, 603, 616, 617, 610, 608, 609, 614, 615; 229/47, 48 SA, 48 SC, 6 A, 46, 45; 292/325

[56] References Cited

U.S. PATENT DOCUMENTS

| | | | |
|---|---|---|---|
| 229,045 | 6/1880 | Johnson | 229/48 SC |
| 1,354,656 | 10/1920 | Joodry | 229/46 |
| 1,497,898 | 6/1924 | Fellowes | 229/46 |
| 1,604,182 | 10/1926 | Markert | 229/47 |
| 2,133,021 | 10/1938 | Ferguson | 229/6 A |
| 2,863,597 | 12/1958 | Strine | 229/47 |
| 3,157,344 | 11/1964 | Hennessey | 206/620 |
| 3,276,666 | 10/1966 | Johnson | 206/557 |
| 3,397,832 | 8/1968 | Thiele | 229/48 SA |
| 3,620,438 | 11/1971 | Wood | 206/611 |

FOREIGN PATENT DOCUMENTS

| | | | |
|---|---|---|---|
| 965,219 | 7/1964 | United Kingdom | 229/6 A |

*Primary Examiner*—William T. Dixson, Jr.

*Assistant Examiner*—Joseph Man-Fu Moy

*Attorney, Agent, or Firm*—Evelyn M. Sommer

[57] ABSTRACT

A poultry container formed from a single blank of paperboard material adhesively joined along a joint comprises two parallel side walls and two parallel end walls disposed perpendicular to the side walls. The side walls and end walls eachinclude an integral, inwardly foldable bottom flap which provide the container with a closed base portion. Each end wall has an integral, inwardly foldable end flap. The end flaps are divided into first and second hingedly connected body portions which when folded provide the end flaps with a two-ply construction. Each side wall includes an integral side flap which is inwardly foldable over the end flaps to close the container. Each side flap includes a pair of spaced parallel perforated lines which extend from the free edge of the side flap to the respective side wall connected thereto. The perforated lines divide each side flap into a center portion which is disposed between two smaller lateral portions. The container is closed by a pair of closing straps disposed around the container. Each of the straps is parallel with and disposed outside of one of the perforated lines on the side flaps, and is closely adjacent to one of the perforated lines on the side flap such that each strap serves as a cutting edge whereby the central portion of each side flap may be opened along the perforated lines to permit inspection of the poultry within the container.

2 Claims, 5 Drawing Figures

POULTRY CONTAINER

BACKGROUND OF THE INVENTION

The subject invention relates to containers for shipping and storing poultry. These containers are generally stacked one on top of another, and because of United States Department of Agriculture standards mandating that there be no moisture leakage from one container to another, said containers commonly include a two piece, solid top panel. From an economical stand point, it is desirable that the subject container have a construction similar to that of boxes currently in common use for other purposes. More particularly, it is desirable that the subject box be formed from a single blank of paperboard stock adhesively joined along a joint, and scored and cut to include four upstanding walls, four bottom flaps which are inwardly foldable over each other to form a closed bottom portion, and four top flaps which are inwardly foldable over each other to close the container. In practice, however, containers of this type have several shortcomings making them impractical for the subject use. For example, such containers generally require the use of metal staples for assembly and closure. However, because of the problems associated with the metal staples coming in contact with the moist poultry products, such containers have been frowned upon by the United States Department of Agriculture. Other containers of said type which employ straps around the container as a closure means instead of staples have also been impractical for the intended use. As will be readily appreciated, the subject containers must provide access to the contents thereof for the purpose of inspection. However, if the closure straps are cut in order to permit inspection, the bottoms of the containers will open causing the contents thereof to fall out. Accordingly, it is the object of the subject invention to provide a poultry container which is very economical to manufacture, and which does not require the use of metal staples for assembly and closure.

It is a further object of the subject invention to provide a poultry container having the above characteristics and which provides an easy and practical access to the contents thereof for inspection, and which meets standards set by the United States Department of Agriculture.

SUMMARY OF THE INVENTION

The poultry container of the subject invention is formed from a single blank of paperboard material, which is adhesively joined along a joint, and scored and cut to include two parallel side walls and two parallel end walls which are integral with and disposed perpendicular to the side walls. Preferably the paperboard is saturated with wax so as to make the container waterproof. In addition, it is preferable that the joint which binds the container extends down the center of one of the end walls so as to provide the container with increased structural strength. The end walls and side walls each include an integral bottom flap which is inwardly foldable to provide the container with a closed base portion. A pair of inwardly foldable end flaps are integral with, and each hingedly connected to one of the end walls. Preferably, each end flap is divided along a fold line into first and second body portions. In practice, the first body portion of each end flap is folded against its respective second body portion so as to provide each end flap with a two-ply construction.

First and second inwardly foldable side flaps are integral with and hingedly connected to the side walls. The side flaps are inwardly folded over the end flaps to close the container. Each of the side flaps includes a pair of spaced, parallel perforated lines which extend from one edge of each side flap to the fold line connecting the side flap to its respective side wall. The perforated lines are so disposed such that each side flap is divided into a central portion disposed between two smaller lateral portions. The container is closed by a pair of straps disposed around the container. Each strap is essentially parallel with and disposed on the outside of one of the perforated lines on the side flap. In addition, each strap is disposed so closely adjacent to one of the perforated lines such that the straps serve as cutting edges whereby the central portion of each side flap may be opened along the perforated lines to permit easy access to the poultry within the container. In the preferred embodiment of the subject invention the container includes at least one drain hole to permit drainage of excess water from the poultry out of the container.

DESCRIPTION OF THE PREFERRED EMBODIMENT

Figure 1:
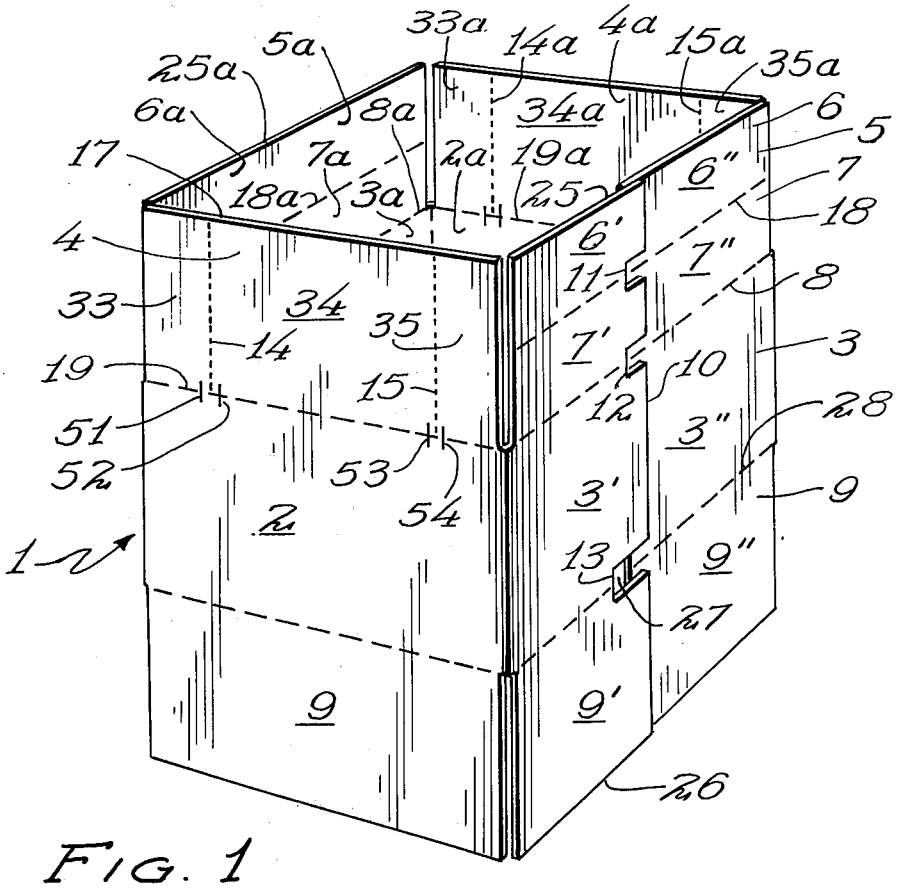
FIG. 1 is a perspective view of the poultry container of the subject invention in which the end flaps, side flaps, and four bottom flaps thereof are opened.

Referring to FIGS. 1–5 the poultry container 1 of the subject invention is made from a single blank of paperboard material adhesively joined along a joint 10. Preferably the paperboard is saturated with wax so as to make the container substantially waterproof. The container 1 includes two parallel side walls 2 and **2*a*, and two parallel end walls 3 and 3*a* which are integral with and disposed perpendicular to the side walls. The side walls 2, 2*a* and end walls 3, 3*a* each include an integral bottom flap 9 (only two shown in FIG. 1), the bottom flaps being inwardly foldable so as to overlie each other and provide the container with a closed base portion for supporting the poultry contained in the container 1. (See FIGS. 2 and 3**)

Further referring to FIG. 1, an end flap 5 is integral with and hingedly connected to end wall 3 along fold line 8. Preferably end flap 5 is divided along an intermediate portion thereof by fold line 18, into first and second body portions 6 and 7. In the preferred embodiment of the subject invention first body portion 6 is folded against second body portion 7, the combination of folded body portions 6 and 7 then being inwardly folded to form an end flap of two-ply construction which is disposed parallel to the base of the container. (See FIG. 5) Similarly, an end flap **5*a* is integral with and hingedly connected to end wall 3*a* along fold line 8*a*. As with end flap 5, end flap 5*a* is divided into two body portions 6*a*** and 7*a*, respectively, which are folded along fold line 18*a* to provide an end flap of two-ply construction. (See FIG. 5) It should be noted that the effective two-ply construction of end flaps 5 and 5*a* increases the dimensional stability of the subject container. In addition, said end flaps provide another function which will be described below.

Further referring to FIG. 1, a side flap 4 is integral with and hingedly connected to side wall 2, along fold line 19. Preferably, side flap 4 is divided by two, spaced, parallel perforated lines 14 and 15 which are essentially perpendicular to and extend from the free edge 17 of the side flap to fold line 19. In addition, it is also preferable that perforated lines 14 and 15 be so disposed such that side flap 4 is divided into three portions including a center portion 34 which is disposed between lateral portions 33 and 35, said lateral portions being smaller in width than center portion 34.

Similarly, a side flap 4*a* is integral with and hingedly connected to side wall 2*a* along fold line 19*a*. (See FIGS. 2 and 3) In addition, side flap 4*a* is also divided by a pair of spaced, parallel perforated lines 14*a* and 15*a* into a center portion 34*a* which is disposed between two smaller lateral portions 33*a* and 35*a*. Preferably, center portions 34 and 34*a* are substantially identical in configuration. As indicated above, the subject container is formed from a single blank of paperboard which is adhesively joined at joint 10. Referring to the drawings, and specifically to FIG. 1, joint 10 extends from the free edge 25 of end flap 5, down the centers of body portions 6 and 7 of end flap 5, end wall 3, and bottom flap 9, to the free edge 26 of said bottom flap. Thus, in reality, first body portion 6 is divided into substantially equal portions 6' and 6'' wherein portion 6' overlaps portion 6''. Similarly second body portion 7, end wall 3, and bottom flap 9 are divided into substantially equal portions 7' and 7'', 3' and 3'', and 9' and 9'', respectively, said single prime portions overlapping the double prime portions. It should be noted that because joint 10 extends essentially down the center of end wall 3 rather than along the corner edge as is common in containers of this general type, the subject container is provided with a stronger glued joint and increased structural strength.

Further referring to the drawings it will be noted that components 6', 7' 3' and 9' include notches extending from joint 10 to intermediate portions of said components. More particularly, the subject container includes notches 11, 12 and 13 which are disposed along fold lines 8, 18 and 28 respectively. Notches 11, 12 and 13 provide relief along the respective fold lines to facilitate folding when the subject container is closed. In addition, it will be noted that notch 13 extends a greater distance from joint 10 than do notches 11 and 12, specifically to a point on portions 3' and 9', where said portions do not overlap portions 3'' and 9'', respectively, such that a drain hole 27 for the flow of excess moisture on the poultry in the container is provided. Additional drain holes such as at 22 (see FIG. 4) may be cut into the subject container to provide increased drainage of water.

Figure 2:
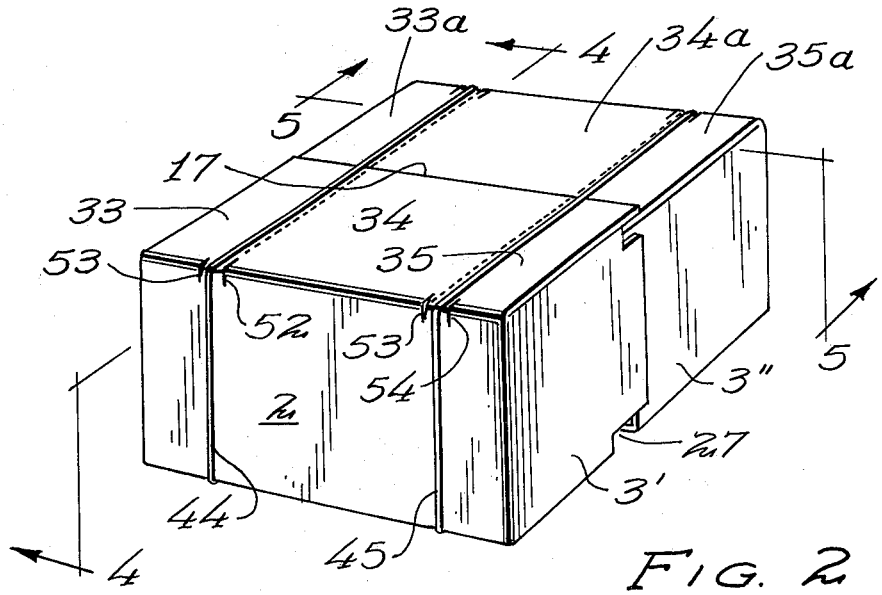
FIG. 2 is a perspective view of the poultry container of the subject invention in the closed state.
Figure 3:
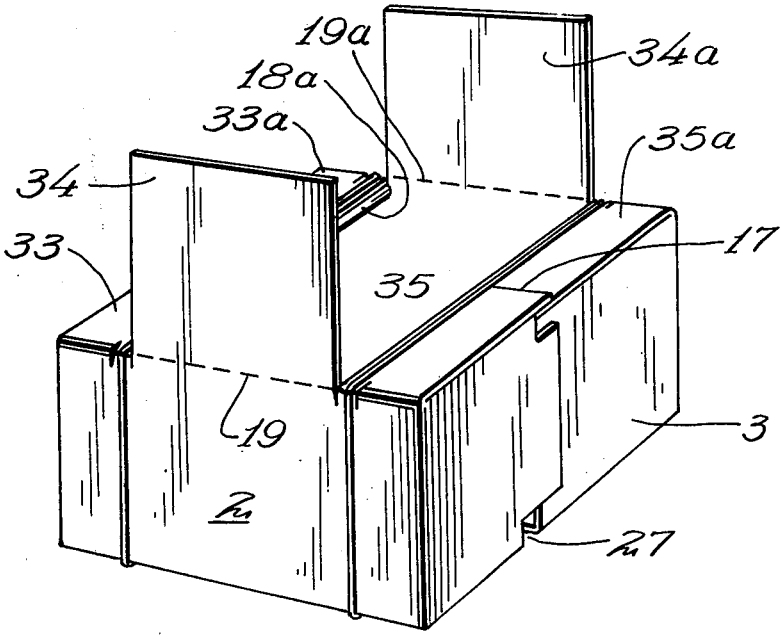
FIG. 3 is a perspective view of the poultry container of the subject invention in which the center portions of the side flaps have been opened to provide access to the contents of the container.
Figure 4:
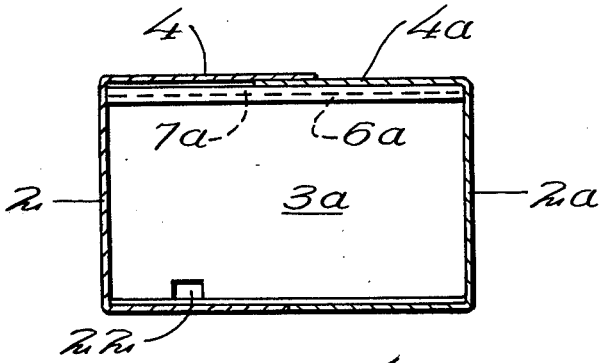
FIG. 4 is a cross sectional view of the poultry container of the subject invention taken along line 4—4 of FIG. 2.
Figure 5:
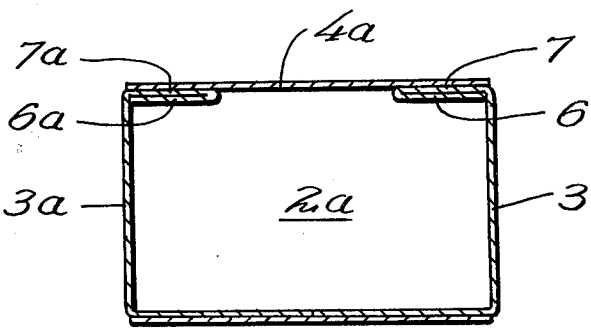
FIG. 5 is a cross sectional view of the poultry container of the subject invention taken along line 5—5 of FIG. 2.

Referring to FIG. 2 the subject container is shown closed, for example after poultry has been packed therein. As is apparent from said Figure, bottom flaps 9 are inwardly folded over each other to form a closed base portion for retaining the poultry. In addition, end flaps 5 and 5*a* are inwardly folded, first body portions 6 and 6*a* being folded against second body portions 7 and 7*a* respectively. Further side flaps 4 and 4*a* are folded over end flaps 5 and 5*a* such that side flap 4 overlies side flap 4*a*. It will be noted that in the preferred embodiment of the subject invention perforated lines 14 and 15 of side flap 4 are essentially aligned with perforated lines 14*a* and 15*a*, respectively, of side flap 4*a*.

Further referring to FIG. 2, a pair of parallel, spaced straps, 44 and 45, typically made out of plastic or a similar flexible material, are disposed around the container 1 for keeping said container closed. Preferably, strap 44 is parallel with and closely adjacent to perforated lines 14 and 14*a*, on the outside of said perforated lines. Similarly, it is preferable that strap 45 be parallel with and closely adjacent to perforated lines 15 and 15*a* on the outside of said perforated lines.

Further referring to FIGS. 1 and 2 the subject container includes two pairs of spaced, parallel slits 51, 52 and 53, 54. Said slits are disposed along fold line 19 such that strap 44 fits between slits 51 and 52, and strap 45 fits between slits 53 and 54. Slits 51, 52, 53 and 54 provide means for retaining straps 44 and 45 in their proper positions during shipping and handling of the subject container.

In addition to maintaining the subject container closed, the straps 44 and 45 perform another function. More particularly, when it becomes necessary to inspect or empty the contents of the container, the container may be easily opened by pulling open side flaps 4 and 4*a* along their respective edges 17 and 17*a*. Such pulling action causes straps 44 and 45 to act as cutting edges along perforated lines 14 and 14*a* and 15 and 15*a* such that center portions 34 and 34*a* may be opened, and access to the contents of the container had. (See FIG. 3) It will be noted that in accordance with the subject invention it is not necessary to cut straps 44 and 45 in order to inspect the contents of the container, and as a result, the container remains a strong receptacle. It will also be noted, as indicated above, that because of the two-ply construction of end flaps 5 and 5*a*, the straps 44 and 45 are very tightly fitted around the container, thus providing a very good tearing edge for opening center portions 34 and 35*a*.

In summary, the subject invention provides a new and improved poultry container which is simple in construction and very economical to manufacture. The subject container does not require the use of metal staples for assembly and closure, and meets United States Department of Agriculture standards. In addition, because of its specific construction, the subject container provides means for easy and practical access to its interior and enables efficient means for inspecting and emptying the contents thereof.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A poultry container formed from a single blank of wax saturated paperboard material adhesively joined along a joint comprising:

two parallel side walls;

two parallel end walls integral with and disposed perpendicular to said side walls, said end walls and side walls each including an inwardly folded bottom flap to provide said container with a closed base portion, said end walls including a drain aperture to permit drainage of excess water from the poultry out of the container;

first and second inwardly folded upright side flaps each being hingedly connected along a fold line to one of said side walls, said closure flaps each having a pair of spaced, parallel perforated lines extending through each of said side flaps from an upper edge of the side flap to the fold line connecting the side flap to its respective side wall, said perforated lines dividing each side flap into a central portion disposed between two smaller lateral portions;

first and second inwardly foldable end flaps, each being integral with and hingedly connected to one of said end walls, each of said end flaps including a first and second body portion, said body portions being divided by a fold line, such that said first body portions may be folded against said second body portions to provide each end flap with a two-ply construction, said side flaps being folded over said end flaps to close the container;

a pair of clothing straps disposed around the container, each of said straps being parallel with and disposed outside of one of the perforated lines on the side flaps, each of said straps being closely adjacent to one of the perforated lines on the side flaps such that each strap serves as a cutting edge whereby the central portions of said side flaps may be opened along the perforated lines thereon to permit inspection of the poultry contained within the container; and two pairs of spaced parallel slits, disposed along the fold line between one of said side flaps and the side wall connected thereto, said pairs of slits being spaced a distance approximately equal to the space between said closing straps, said slits of each pair of slits being spaced a distance approximately equal to the width of one of said closing straps that each strap may be retained in its proper position by one of said pairs of slits.

2. A poultry container as recited in claim 1 in which the joint which binds the container extends down the center of one of the end walls.

* * * * *

UNITED STATES PATENT AND TRADEMARK OFFICE

CERTIFICATE OF CORRECTION

PATENT NO. : 4,126,225

DATED : November 21, 1978

INVENTOR(S) : William C. Hyland and Elmer G. Swanson

It is certified that error appears in the above-identified patent and that said Letters Patent are hereby corrected as shown below:

In Column 6, Claim 1, line 3, delete the word "clothing and insert in lieu thereof -- closing --.

Signed and Sealed this

*Twenty-ninth* Day of *April 1980*

[SEAL]

*Attest:*

SIDNEY A. DIAMOND

*Attesting Officer*

*Commissioner of Patents and Trademarks*